US010806219B2

(12) United States Patent
Langmeier

(10) Patent No.: US 10,806,219 B2
(45) Date of Patent: Oct. 20, 2020

(54) MODULAR TECHNICAL SYSTEM FOR PRODUCING A MODULAR-STRUCTURE FOOT SOLE LAST AND MODULAR-STRUCTURE FOOT SOLE LAST

(71) Applicant: Fatmir Langmeier, Rohrdorf (DE)

(72) Inventor: Fatmir Langmeier, Rohrdorf (DE)

( * ) Notice: Subject to any disclaimer, the term of this patent is extended or adjusted under 35 U.S.C. 154(b) by 268 days.

(21) Appl. No.: 14/427,124

(22) PCT Filed: Sep. 10, 2013

(86) PCT No.: PCT/DE2013/000506
§ 371 (c)(1),
(2) Date: Mar. 10, 2015

(87) PCT Pub. No.: WO2014/040582
PCT Pub. Date: Mar. 20, 2014

(65) Prior Publication Data

US 2015/0237967 A1 Aug. 27, 2015

(30) Foreign Application Priority Data

Sep. 11, 2012 (DE) ..... 20 2012 008 676 U

(51) Int. Cl.
*A43D 3/02* (2006.01)
*A43D 1/02* (2006.01)

(52) U.S. Cl.
CPC ..... *A43D 3/027* (2013.01); *A43D 1/02* (2013.01); *A43D 1/025* (2013.01); *A43D 3/021* (2013.01)

(58) Field of Classification Search
CPC ..... A43D 3/00; A43D 3/021; A43D 3/027; A43D 1/02; A43D 1/025; A43D 3/02; A43D 1/04

(Continued)

(56) References Cited

U.S. PATENT DOCUMENTS 355,565 A 1/1887 Sheeran
1,565,057 A * 12/1925 Chappell ..... A43D 3/027 12/124

(Continued)

FOREIGN PATENT DOCUMENTS

| | | |
|---|---|---|
| DE | 205 610 | 1/1909 |
| DE | 20 2012 008676 | 10/2012 |
| GB | 2 225 210 | 5/1990 |

OTHER PUBLICATIONS

International Search Report for PCT/DE2013/000506 dated Jan. 9, 2014.

(Continued)

*Primary Examiner* — Jameson D Collier
*Assistant Examiner* — Jocelyn Bravo
(74) *Attorney, Agent, or Firm* — B. Aaron Schulman, Esq.; Stites & Harbison, PLLC

(57) ABSTRACT

A modular technical system for creating a patient-data-specifically individualized foot sole last (15) having a modular structure, characterized in that per zone (16; 24, 25, 26, 27) of the foot sole last (15) it comprises respectively one or more mutually exchangeable standard foot sole last modules (17) as standardized components which—after selection of the suitable standard module (17) from orthopaedic aspects for the respective zone (16; 24, 25, 26, 27) of a patient's foot—can be mounted consecutively along the longitudinal axis (22) of the foot sole last (15) in series zone-wise or at least partially adjacently to one another to form a patient-data-specifically individualized foot sole last (15) having a modular structure, wherein the upper sides of the standard modules (17) are configured depending on shoe size and depending on zone (16) as negative to the corresponding zones (16) of the foot of the patient and/or each have a shape which, specific to shoe size and specific to zone (16), corresponds from orthopaedic aspects to the most logical (Continued)

shape for correction or treatment of one specific or several of the statistically most commonly occurring deformities or diseases requiring treatment from orthopaedic aspects and wherein the transitions (23; 28, 29, 30) between two neighbouring standard modules (17; 24, 25, 26, 27)—in the side view—are stepless and smooth and—in the plan view—adjoin one another without gaps.

13 Claims, 11 Drawing Sheets

(58) Field of Classification Search
USPC ..... 12/133 R, 134, 145, 146 L; 36/31
See application file for complete search history.

(56) References Cited

U.S. PATENT DOCUMENTS 1,868,526 A * 7/1932 Dodge ..... A43D 3/027 12/115.6
2,093,247 A * 9/1937 Lucas ..... A43D 3/027 12/133 B
2,274,060 A * 2/1942 Hart ..... A43D 3/02 12/142 R
4,523,345 A * 6/1985 Orea Mateo ..... A43D 3/027 12/133 R
4,841,648 A * 6/1989 Shaffer ..... A43B 7/1465 36/145
5,595,005 A * 1/1997 Throneburg ..... A41B 11/00 36/10
5,718,013 A * 2/1998 Gumbert ..... A43D 3/021 12/133 R
5,724,753 A * 3/1998 Throneburg ..... A43B 7/142 36/10
5,862,555 A * 1/1999 Furuhashi ..... A43B 1/0054 12/128 F
5,881,413 A * 3/1999 Throneburg ..... A43D 3/027 12/128 R
5,909,719 A * 6/1999 Throneburg ..... A43D 3/027 12/133 R
6,092,250 A * 7/2000 Furuhashi ..... A43B 1/0054 12/128 F
7,210,250 B2 * 5/2007 Gallegos ..... A43B 1/0054 36/140
7,644,522 B2 * 1/2010 Ramirez ..... A43B 7/1415 36/155
8,215,037 B2 * 7/2012 James ..... A43B 1/0072 36/103
8,978,275 B2 * 3/2015 James ..... A43B 1/0027 36/103
2003/0088927 A1 * 5/2003 Furuhashi ..... A43D 3/022 12/133 R
2006/0143839 A1 7/2006 Fromme
2006/0277796 A1 * 12/2006 Gallegos ..... A43B 1/0054 36/44
2007/0079532 A1 * 4/2007 Ramirez ..... A43B 7/1415 36/140
2010/0192415 A1 * 8/2010 James ..... A43B 1/0072 36/103

OTHER PUBLICATIONS

Applicant Reply dated Jul. 2, 2014 in response to written communication of the International Searching Authority.
Translation of the International Preliminary Report on Patentability for PCT/DE2013/000506 dated Mar. 11, 2015.

* cited by examiner

MODULAR TECHNICAL SYSTEM FOR PRODUCING A MODULAR-STRUCTURE FOOT SOLE LAST AND MODULAR-STRUCTURE FOOT SOLE LAST

The present invention relates to a modular technical system for producing a modular-structure, patient-data-specified foot sole last (15) having the features specified in the preamble of patent claim 1.

It is known from the prior art—within the framework of the so-called "drawer technique"—for the preparation of insoles to make the patient or sportsman tread in a foot impression foam box where the foot impression foam compresses and deforms whilst adapting to the shape of the sole region of the patient or sportsman. Subsequently the foot sole imprint in the foot impression foam is filled with plaster or polyurethane foam and the foot sole positive image removed from the foot impression foam mould is modeled from plaster or polyurethane foam. Usually the person selling an insole then selects a ready-made insole corresponding to the size of the plaster or polyurethane foam imprint from the ready-made insoles which he has in stock and sells this to the patient or sportsman who is searching for an insole.

This procedure for preparing a ready-made insole, which is known as the "drawer technique" and is very widely used today is particularly disadvantageous because the ready-made insole selected from the stock randomly (still) present at the insole seller with his assistance is not sufficiently adapted to the patient-specific individual needs of the patient or sportsman. The rate of complaints with these ready-made insoles provided by the "drawer technique" is therefore very significant.

It is furthermore known from the prior art to produce an individualized sole last by means of a CNC milling machine available on site at the insole manufacturer and to create insoles made of thermoplastic material using this individualized sole last.

The use of a CNC milling machine available on site at each insole manufacturer is disadvantageous in many respects:

Thus, the acquisition costs for a CNC milling machine are particularly high and as a result, frequently prevent an economically meaningful use at the location of the insole seller.

Furthermore, the operation and maintenance of a CNC milling machine requires technical staff trained in CNC milling which is frequently not available—specifically in remote areas—and if available, requires the commitment of high staff costs.

Another disadvantage of CNC milling can be seen in that it requires a significant time (about 15 minutes) for the milling of a sole last.

The use of CNC milling is also disadvantageous on account of the large amount of accumulating waste since the sole last there is milled from a solid material block and the material excess projecting beyond the sole last accumulates as milled waste.

It is therefore the object of the present invention to provide a technical system which allows the manufacture of individualized foot sole lasts which exactly take into account the personal anatomical circumstances and the orthopaedic needs of the foot of a patient for the shaping of insert foot soles to be moulded thereon, and thereby brings about a particularly low rate of complaints for the manufactured insoles, which makes the presence of numerous CNC milling machines on site at the manufacturers even of extremely individualized insoles superfluous and thereby avoids high acquisition costs, operating costs, maintenance costs and costs for technical staff, which permits the manufacture even of extremely individualized insoles in a very short time (two to five minutes per insole) even by an orthopaedically untrained person and which eliminates a dreaded waste problem of CNC milling machines caused by milled residues.

According to the invention, this object is solved by a generic modular technical system for producing a patient-data-specifically individualized foot sole last (15) having a modular structure having the features of patent claim 1.

Particularly preferred embodiments of the modular technical system for producing a patient-data-specifically individualized foot sole last (15) having a modular structure are the subject matter of the subclaims.

Exemplary embodiments of the invention are described in detail with reference to the drawings. In the figures:

FIG. 1 shows a schematic highly simplified plan view of a patient-data-specifically individualized foot sole last (15) having a modular structure, created with the modular technical system according to the invention comprising zones (16; 24, 25, 26, 27) provided consecutively along the longitudinal axis (22) of the foot sole last (15), wherein in each zone one of a plurality of mutually exchangeable standard modules (17) is provided with a surface shape to compensate for a standard deviation and wherein the transitions (23; 28, 29, 30) between neighbouring modules (17) are configured to be stepless and gapless;

FIG. 2 shows a schematic plan view of a patient-data-specifically individualized foot sole last (15) having a modular structure, created with the modular technical system according to the invention comprising zones (16; 24, 25, 26, 27) provided consecutively and adjacently along the longitudinal axis (22) of the foot sole last (15), wherein in each zone one of a plurality of mutually exchangeable standard modules (17) is provided with a surface shape to compensate for a standard deviation and wherein the transitions (23; 28, 29, 30) between neighbouring modules (17) are configured to be stepless and gapless;

FIG. 3 shows a schematic perspective view from obliquely above of a patient-data-specifically individualized foot sole last (15) shown in FIG. 2 and having a modular structure, created with the modular technical system according to the invention which is partially mounted on a support (31), where the forefoot region (24) of the foot sole last (15) is removed to improve the identifiability of the projections (33) on the upper side of the support (31);

FIG. 4 shows a schematic perspective view from obliquely below of a patient-data-specifically individualized foot sole last (15) shown in FIG. 2 and having a modular structure, created with the modular technical system according to the invention wherein on the underside thereof per standard module (17), two or more borehole-like recesses (32) are provided for fixing engagement of corresponding pin-like projections (32) on the upper side of the support (31);

Figure 8:
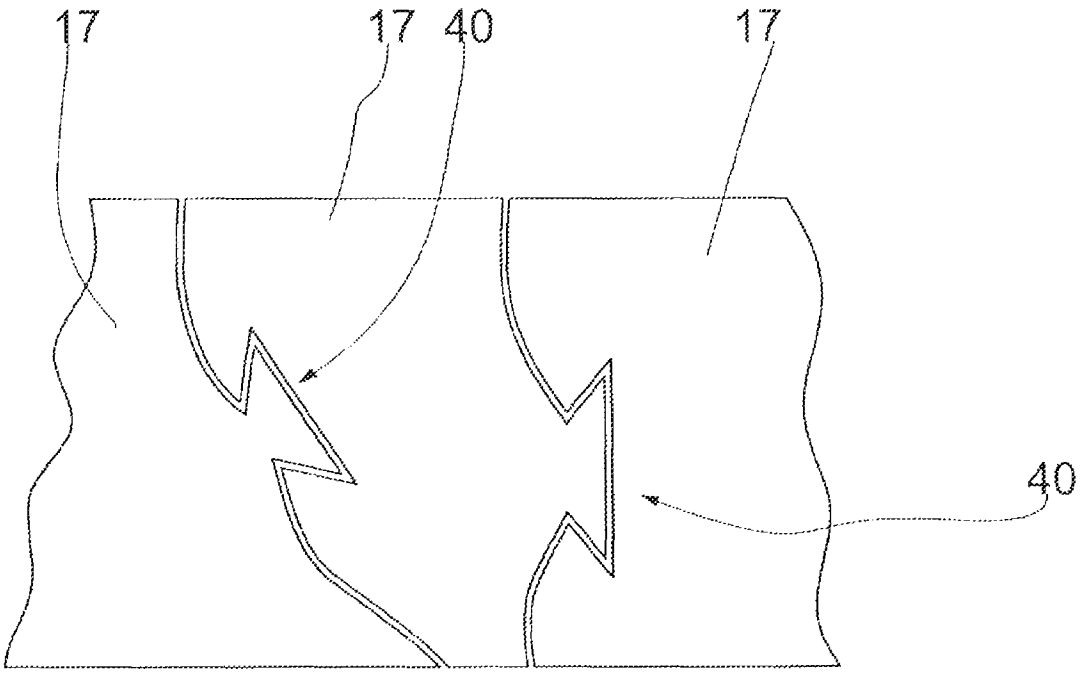
Figure 9:
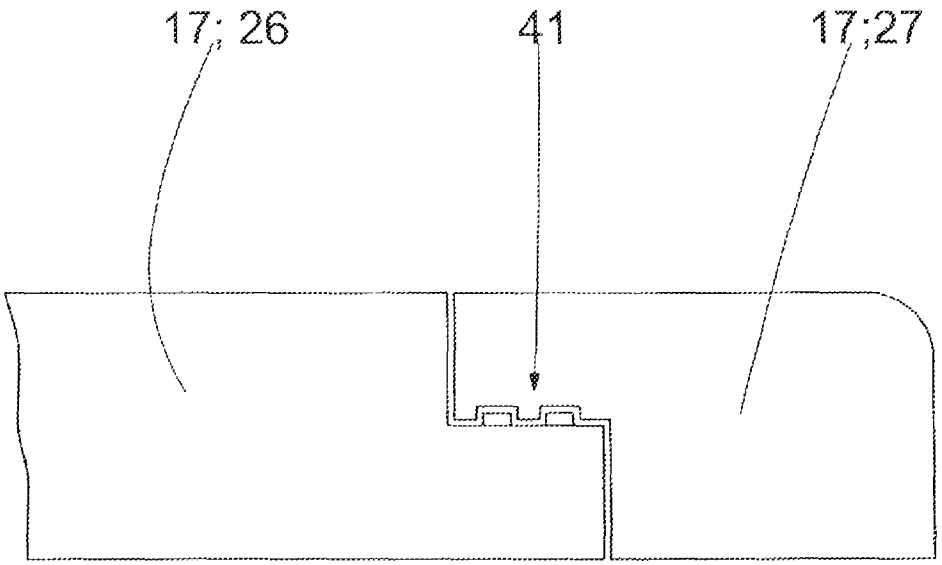
Figure 10:
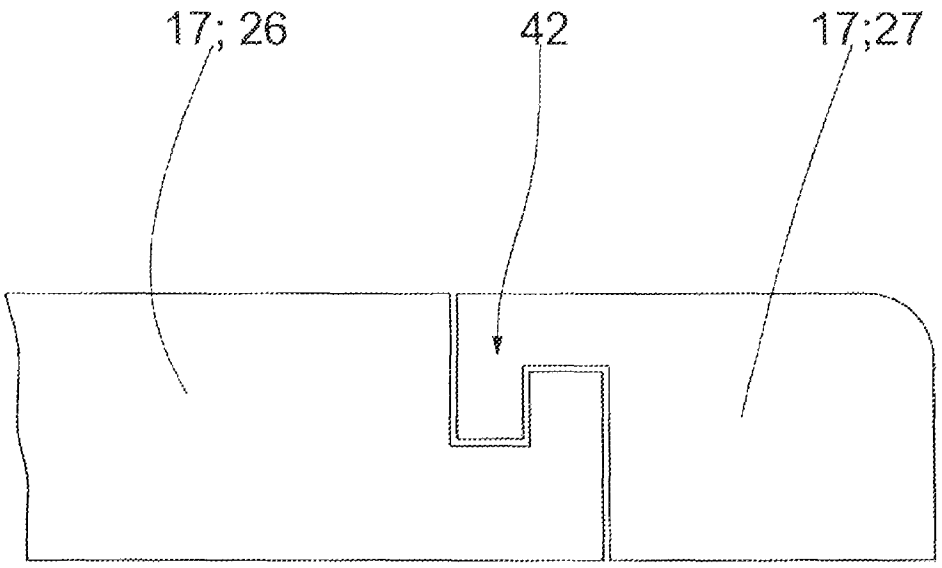
Figure 11:
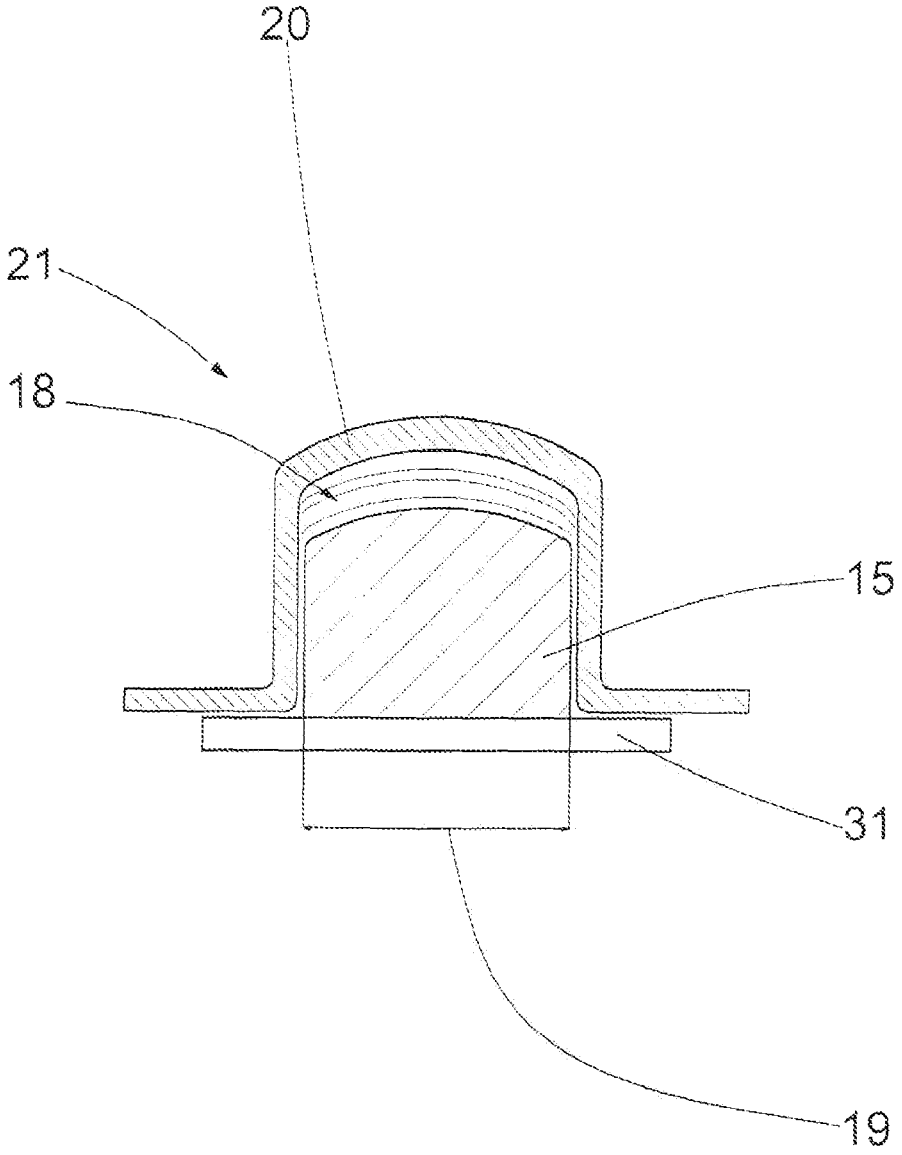

having a modular structure, created with the modular technical system according to the invention wherein balls (38) acted upon with spring force secure a plug-in connection (35) between two neighbouring modules (17);

FIG. 8 shows a schematic, partially cutaway side view of a patient-data-specifically individualized foot sole last (15) having a modular structure, created with the modular technical system according to the invention wherein a swallow-tail connection (40) is provided between two neighbouring standard modules (17);

FIG. 9 shows a schematic, partially cutaway side view of a patient-data-specifically individualized foot sole last (15) having a modular structure, created with the modular technical system according to the invention wherein a clamping modular connection (41) is provided between two neighbouring standard modules (17);

FIG. 10 shows a schematic, partially cutaway side view of a patient-data-specifically individualized foot sole last (15) having a modular structure, created with the modular technical system according to the invention wherein a hook-like connection (41) is provided between two neighbouring standard modules (17);

FIG. 11 shows a schematic section through a patient-data-specifically individualized foot sole last (15) having a modular structure, over which a plurality of heated layers of the insole (18) are laid and wherein a flexible cover (20) of a vacuum press (21) presses the thermoplastic material of the insole (18) onto the upper side of the foot sole last (15) as soon as a negative pressure acts on the intermediate space between the underside of the flexible cover (20) and the foot sole last (15).

The present invention therefore initially relates to a modular technical system for creating a patient-data-specifically individualized foot sole last (15) having a modular structure.

This modular technical system usually comprises per zone (16; 24, 25, 26, 27) of the foot sole last (15) respectively one or more mutually exchangeable standard foot sole last modules (17) as standardized components.

In particularly preferred embodiments of the modular technical system according to the invention, after selection of an exactly fitting standard module (17) from orthopaedic aspects for the respective zone (16; 24, 25, 26, 27) of a patient foot, these standard modules (17) can be mounted consecutively along the longitudinal axis (22) of the foot sole last (15) in series zone-wise to form a patient-data-specifically individualized foot sole last (15) having a modular structure.

Alternatively or additionally to this, the standard modules (17) can be mounted not only consecutively along the longitudinal axis (22) of the foot sole last (15) in series zone-wise but at least partially adjacently to one another to form a patient-data-specifically individualized foot sole last (15) having a modular structure.

Usually the upper side of each standard module (17) can be configured depending on shoe size and depending on zone (16) by means of elevations and/or recesses as negative to the shape of the foot of the subsequent wearer of the insole (18) to be formed with the aid of the foot sole last (15).

Alternatively or additionally, the shape of the upper side of each standard module (17; 24; 25; 26; 27) can each have a shape which, specific to shoe size and specific to zone (16), corresponds from orthopaedic aspects to the most logical shape for correction or treatment of one specific or several of the statistically most commonly occurring deformities or diseases requiring treatment from orthopaedic aspects.

By means of the patient-data-related selection of the particularly suitable standard modules (17) for the individual zones (16) of the foot of the patient or sportsman in each case from orthopaedic aspects, an extremely patient-data-individualized, modular-structure foot sole last (15) can thus be produced with the aid of the modular system according to the invention and then used for shaping an extremely patient-data-individualized insole (18).

An essential feature of the patient-data-specifically individualized foot sole last (15) created with the modular technical system according to the invention consists in that the transitions (23; 28, 29, 30) between two neighbouring standard modules (17; 24, 25, 26, 27)—in the side view—are stepless and smooth and—in the plan view—adjoin one another without gaps.

Figure 1:
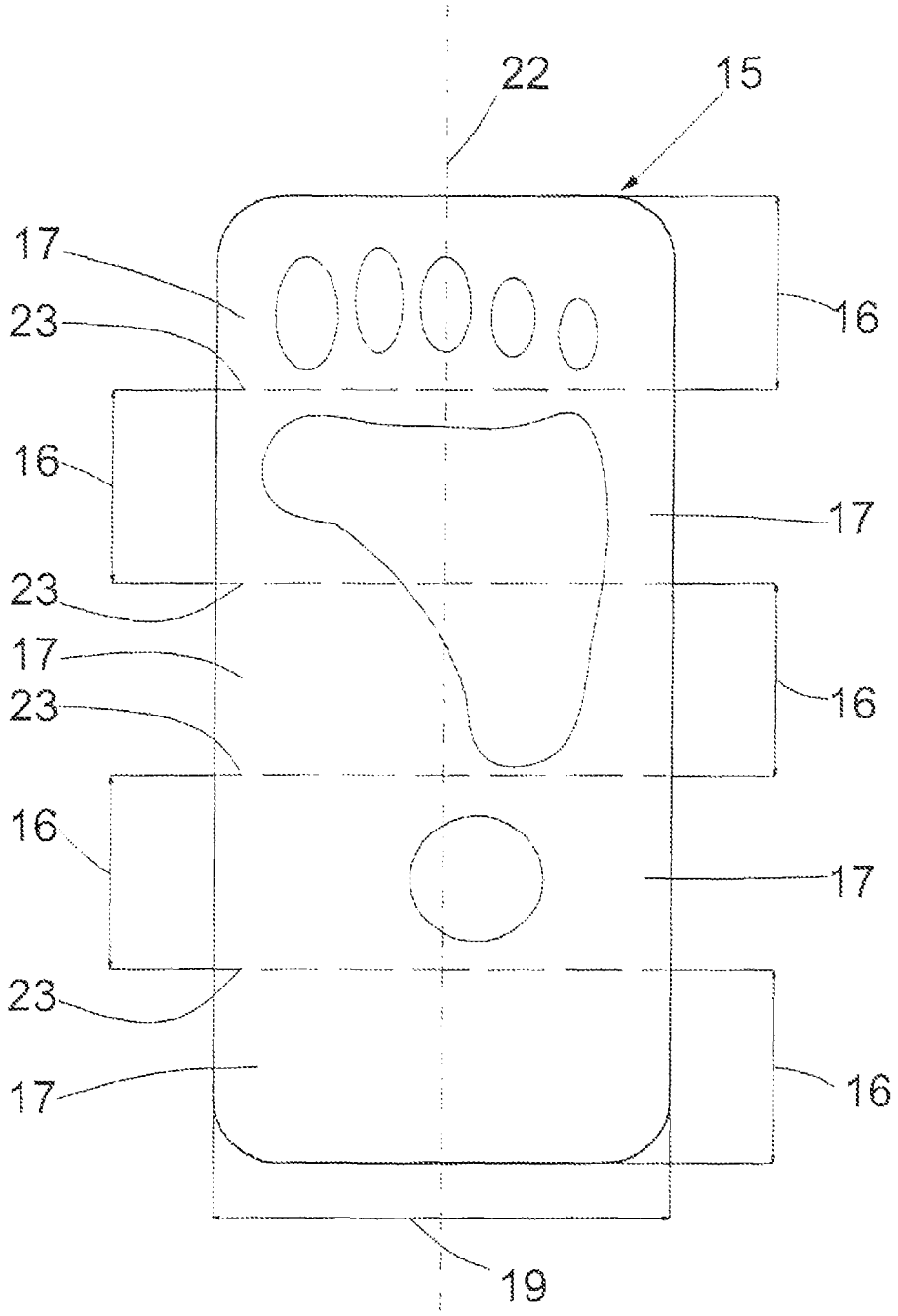
Figure 2:
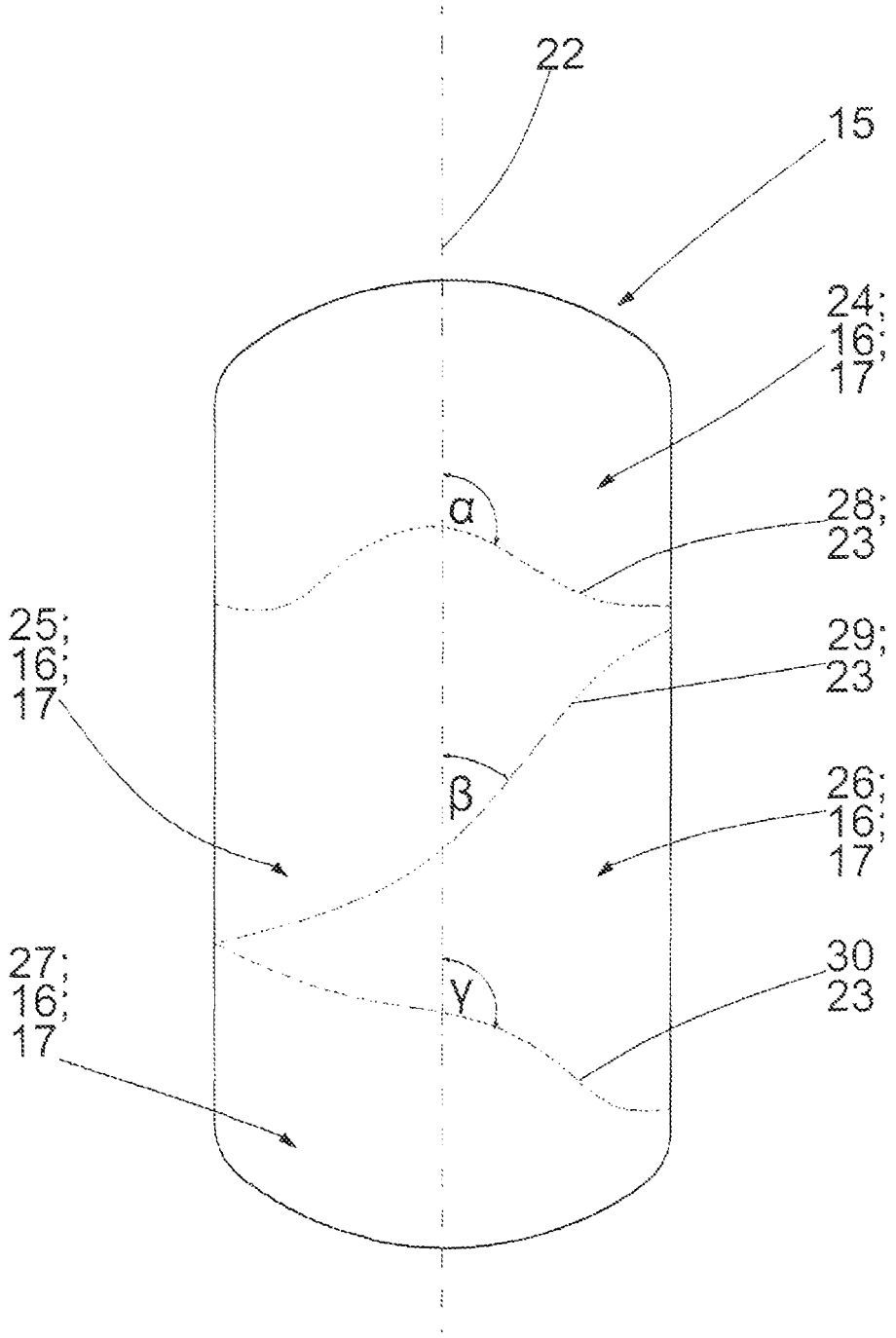

In general, the foot sole last (15) having a modular structure can be divided along its longitudinal axis (22) into three, four, five, six, seven or more imaginary zones (16) located consecutively in series and/or at least partially adjacent to one another (see FIGS. 1 and 2).

Preferably per zone (16) one, two, three, four or more standard modules (17) with respectively standardized zone-specific recesses and/or elevations on their upper side can be contained in the modular technical system for respectively one of the statistically most commonly occurring deformities or diseases requiring treatment from orthopaedic aspects.

As can be seen in particular from FIG. 2, the patient-data-specifically individualized foot sole last (15) having a modular structure can, for example, comprise four zones (16). In this case, the frontward and toe-ward zone (16, 24) covers the fore-foot region with toes and ball of the foot, the subsequent zone (15, 25) in the direction of the heel can, for example, cover the metatarsal region, the subsequent zone (16, 26) in the direction of the heel can, for example, cover the longitudinal arch and the subsequent zone (16, 27) in the direction of the heel can, for example, cover the heel region.

In particular, FIG. 2 shows that the transition (23; 28) between the fore-foot region (24; 16; 17) on the one hand and the metatarsal region (25; 16; 17) on the other hand—in a plan view—can be configured in the form of a singly or multiply curved or straight line, wherein this transition (23; 28) intersects the longitudinal axis (22) of the foot sole last (15) at an angle $\alpha$, which can lie in the range of 70° to 110°.

The transition (29; 23) between the metatarsal region (25; 26; 17) on the one hand and the longitudinal arch (26; 16; 17) on the other hand—in a plan view—can be configured in the form of a singly or multiply curved or straight line, wherein this transition (29; 23) intersects the longitudinal axis (22) of the foot sole last (15), for example, at an angle $\beta$, which lies in the range of 10° to 80°.

The transition (30; 23) between the longitudinal arch (26; 16; 17) on the one hand and the heel region (27; 16; 17) on the other hand—in a plan view—can be configured in the form of a singly or multiply curved or straight line, wherein this transition (30; 23) intersects the longitudinal axis (22) of the foot sole last (15) at an angle $\gamma$, which can lie in a range of 80° to 160°.

In preferred embodiments of the patient-data-specifically individualized foot sole last (15) having a modular structure created according to the invention, the forefoot region (24; 16; 17) can comprise the toe and ball region of the foot of the subsequent wearer of the insole (18) to be manufactured, which is to be corrected from orthopaedic aspects.

The metatarsal region (25; 16; 17) can comprise the foot of the subsequent wearer of the insole (18) to be manufactured in a correcting shape from orthopaedic aspects on the outside from the metatarsophalangeal joint as far as the heel-ward metacarpophalangeal joint and on the inside from the metatarsophalangeal joint as far as the metatarsal joint N1.

The longitudinal arch region (26; 16; 17) can comprise the foot of the subsequent wearer of the insole (18) to be manufactured in a correcting shape from orthopaedic aspects on the outside in the region of the transition between the calcaneal region and the cuboid bone region and on the inside from the metatarsophalangeal joint (metatarsal joint N1) as far as the centre of the calcaneus.

The heel region (27; 16; 17) can comprise the rear half of the calcaneus of the foot of the subsequent wearer of the insole (18) to be manufactured, which is to be corrected from orthopaedic aspects.

Figure 3:
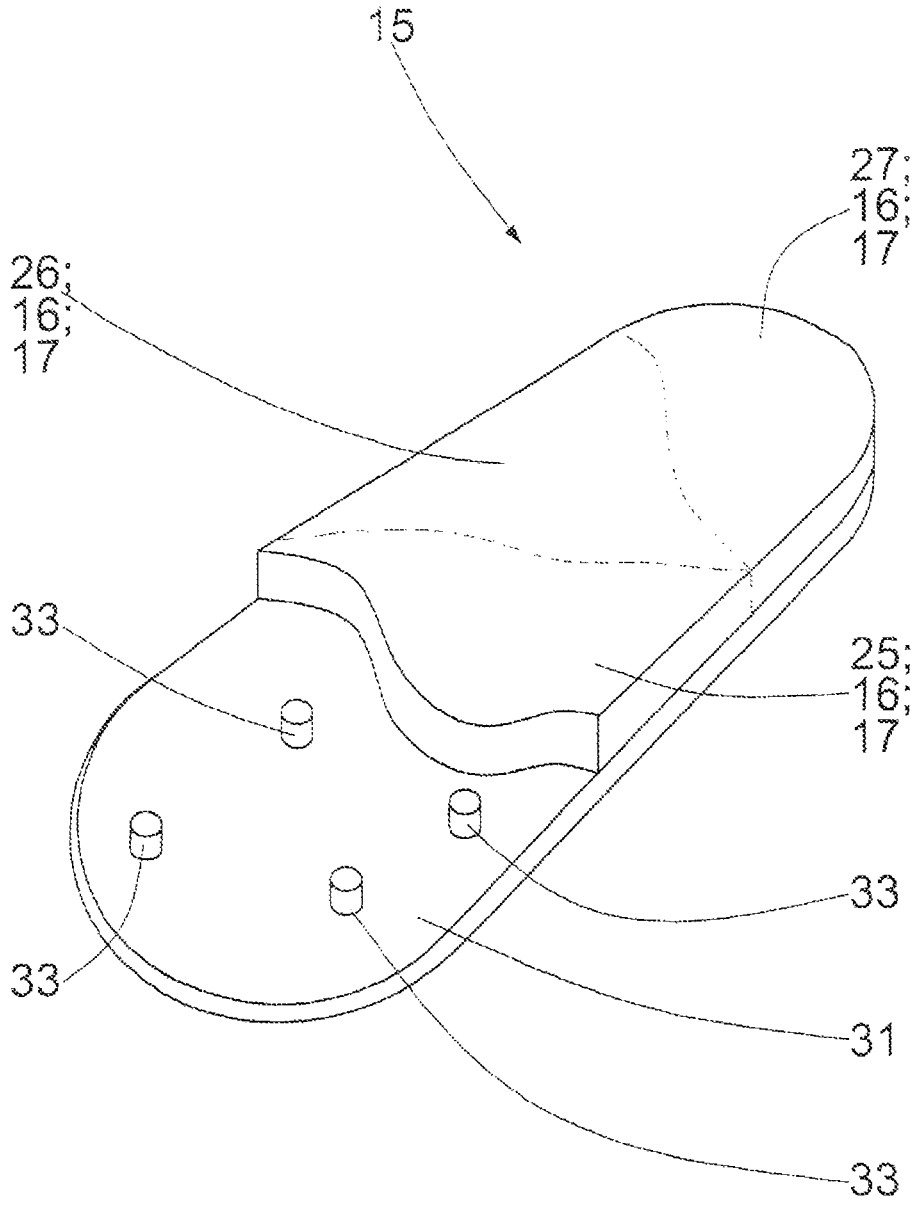
Figure 5:
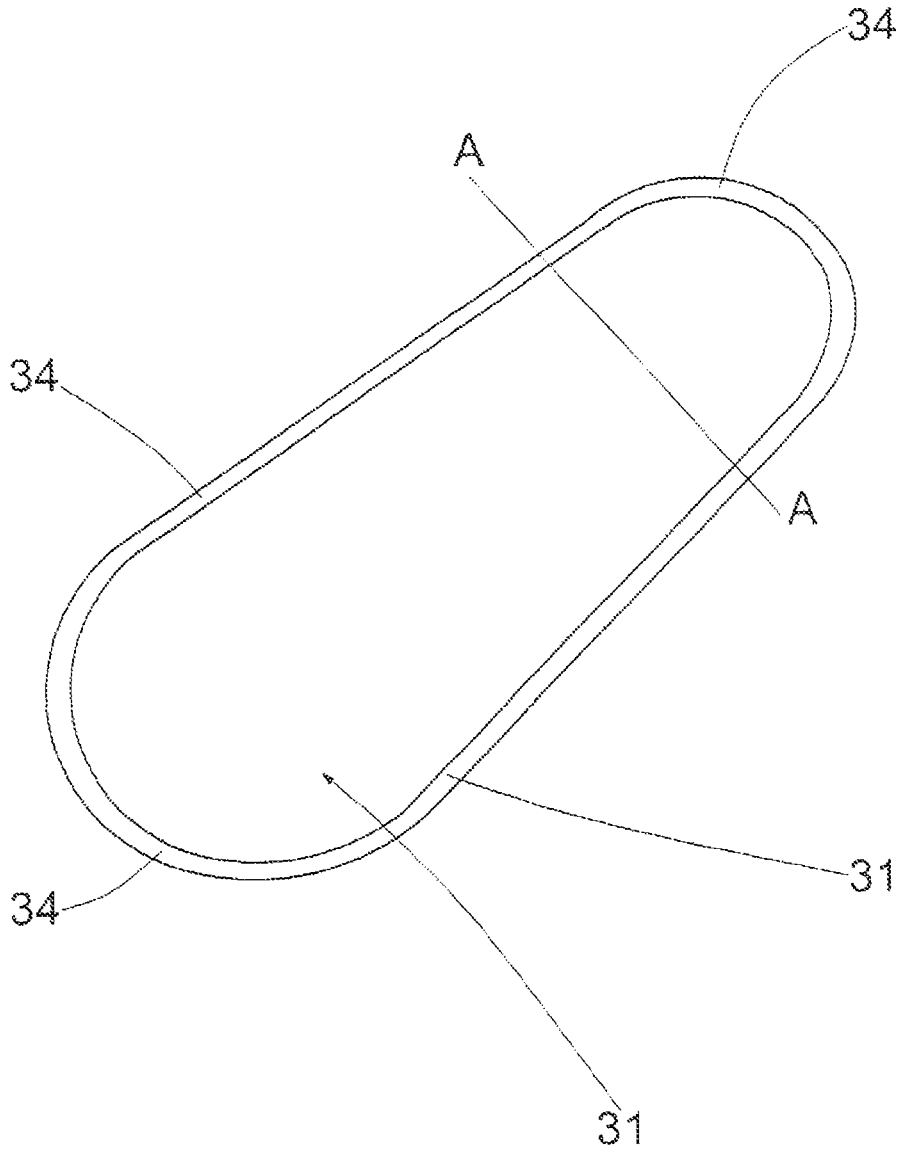
FIG. 5 shows a schematic plan view of a support (31) whose exterior contour is embraced by a bead-shaped elevation or an edge (34), where this edge (34) projects upwards beyond the upper side of the support (31)
Figure 6:
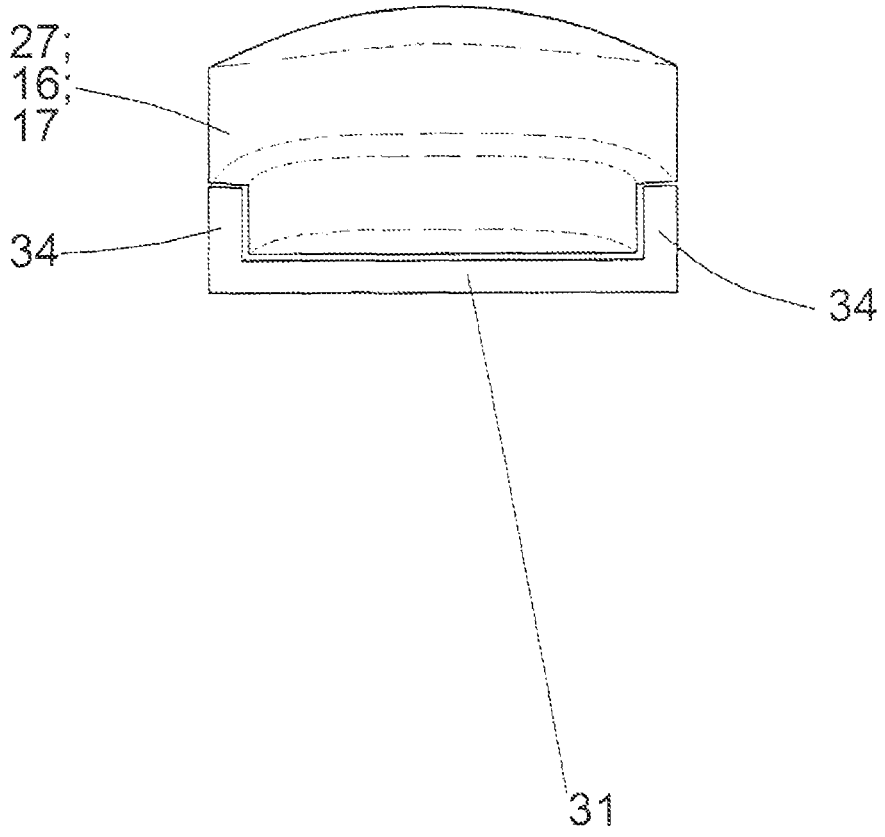
FIG. 6 shows a schematic section through the support (31) shown in FIG. 5 along the line A-A in FIG. 5, where a heel module (17) is inserted in the heel region (27) of the foot sole last (15)

In particular, it can be seen from FIGS. 3, 5 and 6 that the standard modules (17; 24; 25; 26; 27) can be provided consecutively reversibly on a support (31) along the longitudinal axis (22) of the foot sole last (25).

Figure 4:
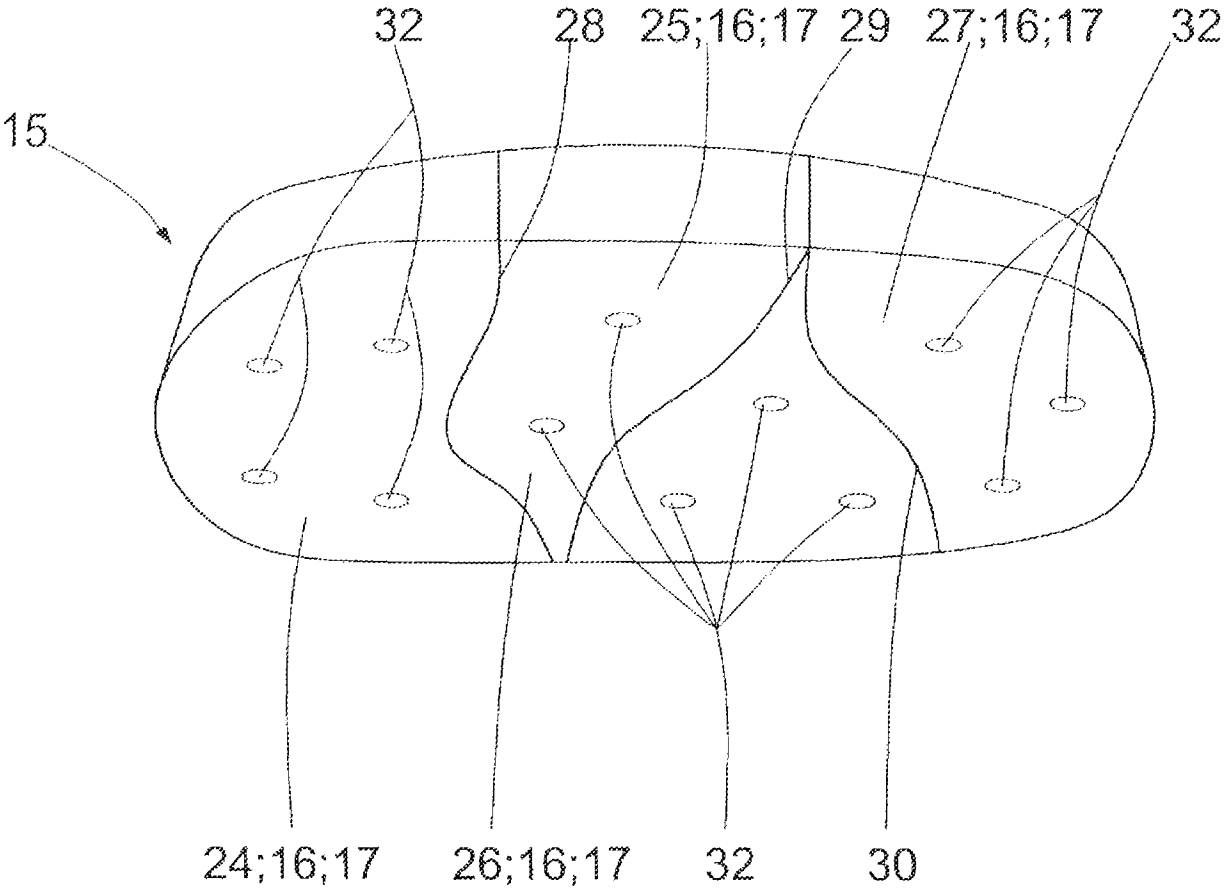

According to FIGS. 3 and 4,—in a first alternative—respectively one or more borehole-like recesses (32) are provided in the undersides of the modules (17; 24; 25; 26; 27) and one or more pin-like projections (33) are provided on the support (31) per zone (16).

Usually the positions of the projections (33) are selected to correspond to the positions of the recesses (32) so that the projections (33) engage in a precisely fitting manner in the recesses (32) and secure the position and alignment of the respective standard module (17; 24; 25; 26; 27) when a standard module (17; 24; 25; 26; 27) is placed in correct alignment on the support (31) in the permissible zone (16) which fundamentally comes into consideration for this module.

In a second alternative pin-like projections (33) corresponding in shape, alignment and position to the borehole-like recesses (32) of the support (31) can be provided on the undersides of the standard modules (17; 24; 25; 26; 27).

Usually the support (31) of the patient-data-specifically individualized foot sole last (15) having a modular structure can be configured in the form of a plate. In particularly preferred embodiments the support (31) can, for example,—in a plan view—be rectangular, square, oval, or curved in a banana shape.

The length of the support (31) usually corresponds, depending on shoe size at least, to the length of the foot sole last (15) to be mounted.

The width of the support (31) is preferably at least the same as the width (19) of the foot sole last (15) to be mounted.

As shown in FIGS. 5 and 6,—in a first embodiment Alternative—the support (31) can carry a bead-shaped edge elevation (34) embracing on the outside the contour of the foot sole last (15) to be mounted in the plan view or on the inside, running parallel to this contour. The standard modules (17; 24; 25; 26; 27) can be inserted or placed according to their association with a specific zone (16) in or on this edge elevation (34).

In particularly preferred embodiments of the patient-data-specifically individualized foot sole last (15) having a modular structure created with the modular technical system according to the invention, the upper side of the support (31) and the undersides of the standard modules (17; 24; 25; 26; 27)—in a first embodiment alternative—can each carry a hook and loop fastening device over the entire area or in sections so that the standard modules (17; 24; 25; 26; 27)—secured against slipping—can be combined on the support (31) to the individualized foot sole last (15) having a modular structure and the ready-mounted foot sole last (15) is then sufficiently stable for the vacuum forming and pressing of the thermoplastic materials of the insole (18).

In a second embodiment alternative, a magnetic fixing device can be provided over the entire area or in sections between the upper side of the support (31) and the undersides of the standard modules (17; 24; 25; 26; 27) so that after placement on the support (31) each standard module (17; 24; 25; 26; 27) is displaceable reversibly and easily for correction purposes.

In particularly preferred embodiments, the transitions (23; 28; 29; 30) in the plan view can be configured to be singly or multiply curved or notched in such a manner that in the case of pressing a zone-related subsequent module (17; 25; 26; 27) along the longitudinal axis (22) of the foot sole last (15) onto the zone-related preceding module (17; 24; 26; 27), they have a self-centring effect in relation to the longitudinal axis (22) of the foot sole last (15).

Figure 7:
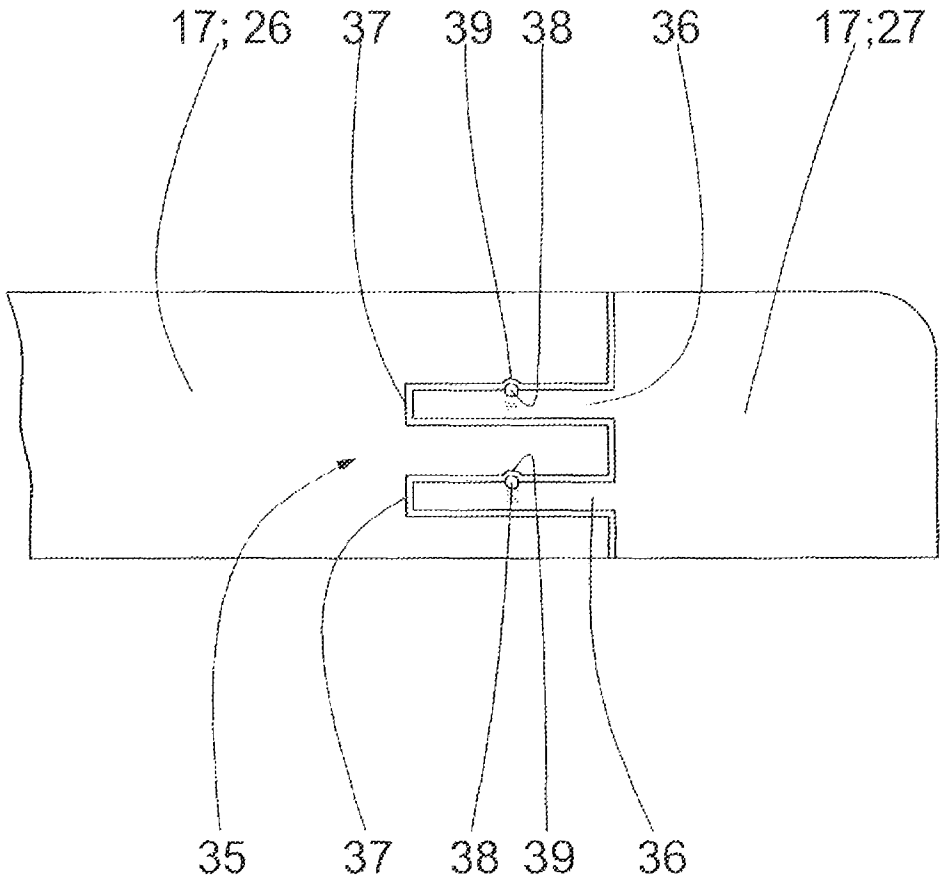
FIG. 7 shows a schematic, partially cutaway side view of a patient-data-specifically individualized foot sole last (15)

According to FIG. 7, the consecutively and/or adjacently neighbouring standard modules (17; 24; 25; 26; 27) along the longitudinal axis (22) of the foot sole last (15) can each be detachably connected to one another via one or more plug-in connections (35).

In this case, one standard module (17; 24; 25; 26; 27) can have one or more pin-like projections (36) pointing in the direction of the neighbouring standard modules (17; 24; 25; 26; 27) and the other standard module (17; 24; 25; 26; 27) can have one or more insertion-bore-like recesses (37) corresponding to the projections (36).

The projections (36) can, for example, engage in the recesses (37) when neighbouring standard modules (17; 24; 25; 26; 27) have been correctly mounted.

In particularly preferred embodiments, balls (38) which can be acted upon by spring force can be integrated in the projections (36) or in the recesses (37), which in the case of a complete insertion of the projections (36) into the recesses (37) snap into opposite recesses (39) and thereby secure the correct module connection.

It can be seen from FIGS. 8, 9 and 10 that the consecutively and/or adjacently neighbouring standard modules (17; 24; 25; 26; 27) along the longitudinal axis (22) of the foot sole last (15) can each be detachably connected to one another via one or more—in the plan view or in the side view—swallowtail-like connections (40; FIG. 8) or clamping-assembly-like connections (41; FIG. 9) or hook-like connections (42; FIG. 10) or by means of a tension belt embracing the foot sole last (15).

Usually the shaping of the upper sides of the standard module (17) can be selected in such a manner that it has a positive influence on the statistically most commonly occurring deformities or diseases requiring treatment from orthopaedic aspects.

Usually the shaping of the upper sides of the standard module (17) is selected zone-wise (16) in such a manner that it has a positive influence on the statistically most commonly occurring deformities or diseases requiring treatment from orthopaedic aspects wherein these deformities or diseases are selected from the group which comprises the presence of a flat foot, talipes valgus, pes cavus, splayfoot, calcaneal spur, hammer toes, muscle shortening, fascial shortening, postural defects, deviations from normal stasis, deviations from the shape and speed of the standard gait degradation line, deviations from the standard weight or a gait pattern which differs from the standard and diabetes.

In addition to the modular technical system, the present invention also comprises a patient-data-specifically individualized foot sole last (15) having a modular structure.

An essential feature of the foot sole last (15) according to the invention consists in that it is constructed in modular fashion of two, three, four, five, six or more standard modules (17; 24; 25; 26; 27).

Usually these standard modules (17) can be provided zone-related (16) consecutively and/or at least partially adjacently along the longitudinal axis (22) of the foot sole last (15).

The shape of the upper side of each standard module (17; 24; 25; 26; 27) can in each case, specific to shoe size and specific to zone (16), correspond as a negative to the shape of the foot of the subsequent wearer of the insole (18) and/or have a shape which from orthopaedic aspects is the most logical shape for correction or treatment of one specific or several of the statistically most commonly occurring deformities or diseases requiring treatment from orthopaedic aspects.

An essential feature of the foot sole last (15) having a modular structure according to the invention can be seen in that the transitions (23; 28; 29; 30) between two neighbouring standard modules (17; 24; 25; 26; 27) are each substantially smooth and stepless although each standard module (17) has a surface shaping different from the surface shaping of the neighbouring standard modules (17) depending on the deformity or disease to be corrected.

In summary it can now be ascertained that a modular technical system for producing foot sole lasts (15) having a modular structure is provided within the framework of the present invention which allows the manufacture of individualized foot sole lasts (15) for the subsequent shaping of insoles (18) which exactly take into account the anatomical conditions and the orthopaedic requirements of the foot of a patient or sportsman and thereby give reason to expect a particularly low rate of complaints for the manufactured insoles (18).

A particular advantage of the modular technical system according to the invention for producing a foot sole last (15) having a modular structure can further be seen in that it no longer requires and even makes superfluous the presence of numerous milling machines on site at the manufacturers themselves of extremely individualized insoles (18) and as a result avoids high acquisition costs, operating costs, maintenance costs and costs for technical staff. An essential advantage of the modular technical system according to the invention for producing a foot sole last (15) having a modular structure further consists in that it even allows an orthopaedically untrained person to produce even extremely individualized insoles (18) in a very short time (two to five minutes per insole).

The modular technical system according to the invention for producing a foot sole last (15) having a modular structure is finally also advantageous because it reliably eliminates the dreaded waste problem of CNC milling machines caused by milled residues.

The same applicant has made the subject matter of a separate patent application having the same filing date a method for patient-data-based selection of zone-specific (16; 24, 25, 26, 27) modules (17) of a foot sole last (15) having a modular structure and divided into several zones (16) and/or also for the patient-data-based determination of materials and the structure of the insole (18) to be shaped subsequently on the modular foot sole last (15) by the action of heat and vacuum pressing.

The invention claimed is:

1. A modular insole last for forming a customized insole, wherein the insole last is specifically tailored according to data taken from a patient, the modular insole last comprising:

a plurality of zones defined in a consecutive series extending along a longitudinal axis of the insole last, each zone having a respective set of two or more insole last modules that are mutually exchangeable with one another such that for each zone, each of the two or more insole last modules is configured to be individually mounted along the longitudinal axis, wherein for each zone, a selection of a respective module from the respective set of modules can be made based on orthopaedic aspects indicated by the data taken from the patient; and a support, wherein the respective selected modules are configured to be removably and consecutively mounted on the support along the longitudinal axis of the insole last in correspondence with the consecutive series, to form the modular insole last that is specifically tailored according to data taken from the patient, wherein, after the respective modules have been mounted consecutively on the support, the customized insole can be formed as a reverse impression of the insole last, such that a lower side of the insole conforms to an upper side of each of the mounted modules in each respective zone, wherein the upper side of each module comprises a shape which, specific to shoe size and specific to the zone of the insole last, is configured for correction or treatment of one or more deformities or diseases requiring orthopaedic treatment, wherein, after the respective modules have been mounted consecutively on the support, each transition between a corresponding pair of the selected modules that are neighboring to one another is, in a side view, stepless and smooth and, in a plan view, gapless, and wherein the support comprises a central upper surface and an edge elevation located along an exterior contour of the support and projecting upwards beyond a height of the central upper surface, wherein the respective modules selected for the respective zones of the insole last are inserted or placed within or on the edge elevation, according to the respective zones of the insole last.

2. The modular insole last according to claim 1, wherein the plurality of zones defined in the consecutive series includes at least three zones of the insole last, and wherein the respective set of modules for each zone of the insole last includes at least one module with at least one of respectively predefined zone-specific recesses and respectively predefined zone-specific elevations on the upper side of the module that is at least one of: configured as a negative to a shape of the foot of the subsequent wearer of the insole formed using the insole last, and configured for correction or treatment of one or more deformities or diseases requiring orthopaedic treatment.

3. The modular insole last according to claim 1, wherein the plurality of zones of t the insole last comprises four zones including a first, frontward and toe-ward zone that is configured to correspond to a fore-foot region with toes and a ball of a foot, a second zone that is subsequent to the first zone in a direction of a heel of the foot that is configured to correspond to a metatarsal region, a third zone that is subsequent to the second zone in the direction of the heel of the foot that is configured to correspond to a longitudinal arch, and a fourth zone that is subsequent to the third zone in the direction of the heel of the foot that is configured to correspond to a heel region.

4. The modular insole last according to claim 3, wherein, upon the respective modules selected for the zones of the insole last being mounted consecutively along the longitudinal axis of the insole last in correspondence with the consecutive series, the transition between the respective module selected for the first zone and the respective module selected for the second zone is formed as a singly or multiply curved or straight line that intersects the longitudinal axis of the insole last at an angle α that is in a range of 70° to 110°, the transition between the respective module selected for the second zone and the respective module selected for the third zone is formed as a singly or multiply curved or straight line that intersects the longitudinal axis of the insole last at an angle β that is in a range of 10° to 80°, and the transition between the respective module selected for the third zone and the respective module selected for the fourth zone is formed as a singly or multiply curved or straight line that intersects the longitudinal axis of the insole last at an angle y that is in a range of 80° to 160°.

5. The modular insole last according to claim 3, wherein the first zone is configured to correspond to a toe and ball region of the foot of a subsequent wearer of the insole, wherein the second zone is configured to correspond to a region covering an exterior side of the foot of the subsequent wearer extending from a metatarsophalangeal joint to a heel-ward metatarsophalangeal joint and an interior side of the foot of the subsequent wearer extending from the metatarsophalangeal joint to a metatarsal joint N1, wherein the third zone is configured to correspond to the exterior side of the foot of the subsequent wearer in a region of a transition between a calcaneal region and a cuboid bone region and the interior side of the foot of the subsequent wearer extending from the metatarsal joint N1 to a center of a calcaneus, and wherein the fourth zone is configured to correspond to a rear half of the calcaneus of the foot of the subsequent wearer.

6. The modular insole last according to claim 1, wherein one or more borehole-like recesses are provided in an underside of the respective module selected for each zone of the insole last, and one or more corresponding pin-like projections are respectively provided on the support for each zone of the insole last in positions that correspond to positions of the recesses provided in the respective module selected for the zone of the insole last, so that the one or more projections engage the one or more corresponding recesses in a precisely fitting manner to secure a position and alignment of the respective module when the respective module is mounted in correct alignment with the zone of the insole last on the support; or one or more pin-like projections are respectively provided on the underside of the respective module selected for each zone of the insole last, and one or more corresponding borehole-like recesses are respectively provided in the support for each zone of the insole last in positions that correspond to positions of the projections provided on the respective module selected for the zone of the insole last, so that the one or more projections engage the corresponding one or more recesses in a precisely fitting manner to secure the position and alignment of the respective module when the respective module is mounted in correct alignment with the zone of the insole last on the support.

7. The modular insole last according to claim 1, wherein the support is configured in the form of a plate having a shape that, in a plan view, is rectangular, square, oval, or curved in a banana shape, the support having a length that is at least as long as a length of the insole last and a width that is at least as wide as a width of the insole last.

8. The modular insole last according to claim 1, wherein an upper side of the support and the undersides of the respective modules selected for the zones of the foot sole last each comprise a hook and loop fastener over an entire area or in sections so that the respective selected modules are secured in place on the support, or wherein a magnetic fixing device is provided over an entire area or in sections between an upper side of the support and the undersides of the respective modules selected for the zones of the insole last so that, upon being mounted on the support, each respective selected module is reversibly and easily displaceable for correction purposes.

9. The modular insole last according to claim 1, wherein the transitions in the plan view are configured to be singly or multiply curved or notched in such a manner that when each corresponding neighboring pair of respective modules is mounted on the support along the longitudinal axis of the insole last, the corresponding pair is centered in relation to the longitudinal axis of the insole last.

10. The modular insole last according to claim 1, wherein, upon the respective modules selected for the zones of the insole last being mounted consecutively along the longitudinal axis of the insole last in correspondence with the consecutive series, each corresponding pair of the respective selected modules that are neighboring to one another along the longitudinal axis of the insole last are detachably connected to one another via one or more plug-in connections, in which a first module of the corresponding pair has one or more pin-like projections pointing in a direction of a second module of the corresponding pair, and the second module has one or more insertion-bore-like recesses corresponding to the projections of the first module, wherein, for each corresponding pair of the respective selected modules that are neighboring to one another along the longitudinal axis of the insole last, the one or more projections of the first module engage in the one or more recesses of the second module when the corresponding pair of modules has been mounted, and wherein at least one of the one or more projections of the first module or at least one of the one or more recesses of the second module includes one or more spring-activated balls, such that, upon a complete insertion of the at least one projections into the at least one recess, the one or more balls snap into opposite recesses to secure a correct connection of the corresponding pair of the respective selected modules.

11. The modular insole last according to claim 1, wherein, upon the respective modules selected for the zones of the foot sole last being mounted consecutively along the longitudinal axis of the foot sole last in correspondence with the consecutive series, each corresponding pair of the respective selected modules that are neighboring to one another along the longitudinal axis of the foot sole last are detachably connected to one another via one or more swallowtail-like connections, clamping-assembly-like connections, or hook-like connections, or by means of a tension belt embracing the foot sole last.

12. The modular insole last according to claim 1, wherein the one or more deformities or diseases requiring orthopaedic treatment are selected from a group consisting of: flat footedness, talipes valgus, pes cavus, splayfoot, calcaneal spur, hammer toes, muscle shortening, fascial shortening, postural defects, deviations from normal stasis, deviations from a shape and speed of a gait degradation line, deviations from a weight or a gait pattern, and diabetes.

13. A modular insole last for forming a customized insole, wherein the insole last is specifically tailored according to data taken from a patient, the modular insole last comprising:

a plurality of zones defined in a consecutive series extending along a longitudinal axis of the insole last, each zone having a respective set of two or more insole last modules that are mutually exchangeable with one another such that for each zone, each of the two or more insole last modules is configured to be individually mounted along the longitudinal axis, each module having a symmetrical shape relative to the longitudinal axis when viewed in a top plan view, wherein for each zone, a selection of a respective module from the respective set of modules can be made based on orthopaedic aspects indicated by the data taken from the patient; and a support, wherein the respective selected modules are configured to be removably and consecutively mounted on the support along the longitudinal axis of the insole last in correspondence with the consecutive series, to form the modular insole last that is specifically tailored according to data taken from the patient, wherein, after the respective modules have been mounted consecutively on the support, the customized insole can be formed as a reverse impression of the insole last, such that a lower side of the insole conforms to an upper side of each of the mounted modules in each respective zone, wherein the upper side of each module comprises a shape which, specific to shoe size and specific to the zone of the insole last, is configured for correction or treatment of one or more deformities or diseases requiring orthopaedic treatment, wherein, after the respective modules have been mounted consecutively on the support, each transition between a corresponding pair of the selected modules that are neighboring to one another is, in a side view, stepless and smooth and, in a plan view, gapless, and wherein the support comprises a central upper surface and an edge elevation located along an exterior contour of the support and projecting upwards beyond a height of the central upper surface, wherein the respective modules selected for the respective zones of the insole last are inserted or placed within or on the edge elevation, according to the respective zones of the insole last.

* * * * *